US009656382B1

(12) United States Patent
Comeau

(10) Patent No.: US 9,656,382 B1
(45) Date of Patent: May 23, 2017

(54) TOOL FIXTURE FOR ELECTRICALLY-POWERED HAND TOOLS

(71) Applicant: Wayne Comeau, New Brunswick (CA)

(72) Inventor: Wayne Comeau, New Brunswick (CA)

( * ) Notice: Subject to any disclaimer, the term of this patent is extended or adjusted under 35 U.S.C. 154(b) by 0 days.

(21) Appl. No.: 15/195,171

(22) Filed: Jun. 28, 2016

(51) Int. Cl.
*B24B 7/00* (2006.01)
*B25H 1/00* (2006.01)
*B24B 23/00* (2006.01)

(52) U.S. Cl.
CPC ..... *B25H 1/0042* (2013.01); *B24B 23/005* (2013.01)

(58) Field of Classification Search
CPC ..... B24B 23/005; B25H 1/0042
USPC ..... 248/674; 451/67, 231, 278, 340, 364, 451/411
See application file for complete search history.

(56) References Cited

U.S. PATENT DOCUMENTS 2,772,525 A 12/1956 Fowler
3,871,137 A 3/1975 Grammatico
6,068,543 A * 5/2000 Renn ..... B23D 59/007 29/26 A
6,669,541 B2 * 12/2003 Andrews ..... B24B 23/005 451/342
2008/0248733 A1 10/2008 Mueller et al.
2013/0017768 A1 1/2013 Bales
2015/0072596 A1 3/2015 Olberg et al.

FOREIGN PATENT DOCUMENTS

CN 203109723 U 8/2013
DE 3627689 A1 2/1988

* cited by examiner

*Primary Examiner* — Todd M Epps

(57) ABSTRACT

A tool fixture can include a plate, a first bolt, a first aperture, and a pin actuator assembly. The first bolt can extend away from a top surface of the plate and have threads of a first thread configuration. The first aperture can be disposed on an opposite side of the plate relative to the first bolt and can extend through the plate and be at least partially threaded with threads of the first thread configuration. The pin actuator assembly can include a base and a pin. The base can extend away from the top surface and can be engaged with the plate for rotation. The pin can be mounted in the base for movement between a retracted position and an extended position. The base can be disposed on an opposite side of the plate relative to the first aperture.

20 Claims, 6 Drawing Sheets

TOOL FIXTURE FOR ELECTRICALLY-POWERED HAND TOOLS

BACKGROUND

1. Field

The present disclosure relates to a structure for encasing or supporting a grinding device or another electrically-powered hand tool.

2. Description of Related Prior Art

U.S. Pat. No. 3,871,137 discloses a Safety Holder for Electrically Powered Hand Grinders. The safety holder for electrically powered hand grinders is intended to be clamped to either a vertical or horizontal surface to hold the grinder in a fixed position relative thereto, the holder including a flat C-shaped base member terminating in one end in an inverted U-shaped member, the bight portion of the U-shaped member supporting thereon and co-planar therewith a U-shaped bracket adapted to rest the body of the grinder therein and having an L-shaped locking member pivoted at one end to an edge of the bracket for closing the open top end of the bracket to securely hold the grinder in the bracket, the locking member secured to the bracket by a threaded bolt which is threadedly received in the bracket.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A tool fixture can include a plate, a first bolt, a first aperture, and a pin actuator assembly. The plate can extend a width along a first axis between a right end and a left end. The plate can also extend a depth along a second axis perpendicular to the first axis and between a forward end and a rearward end. The plate can also extend a height along a third axis perpendicular to the first axis and the second axis and between a top surface and a bottom surface. The first axis and the second axis and the third axis can intersect one another at a point evenly spaced between the right end and the left end and evenly spaced between the forward end and the rearward end and evenly spaced between the top surface and the bottom surface. The first bolt can extend away from the top surface and have threads of a first thread configuration. The first aperture can be disposed on an opposite side of the plate relative to the first bolt across the second axis. The first aperture can extend through the plate and be at least partially threaded. The first aperture can have threads of the first thread configuration. The pin actuator assembly can include a base and a pin. The base can extend away from the top surface and can be disposed on an opposite side of the plate relative to the first bolt across the second axis. The base can be engaged with the plate for rotation about a fourth axis at least partially spaced from the third axis. The base can be positioned on a same side of the plate as the first aperture with respect to the second axis. The pin can be mounted in the base for movement between a retracted position in which a first portion of the pin is enclosed in the base and an extended position in which a second portion of the pin less than the first portion is enclosed in the base. The base can be disposed on an opposite side of the plate relative to the first aperture across the first axis.

BRIEF DESCRIPTION OF THE DRAWINGS

The detailed description set forth below references the following drawings.

DETAILED DESCRIPTION

Figure 1:
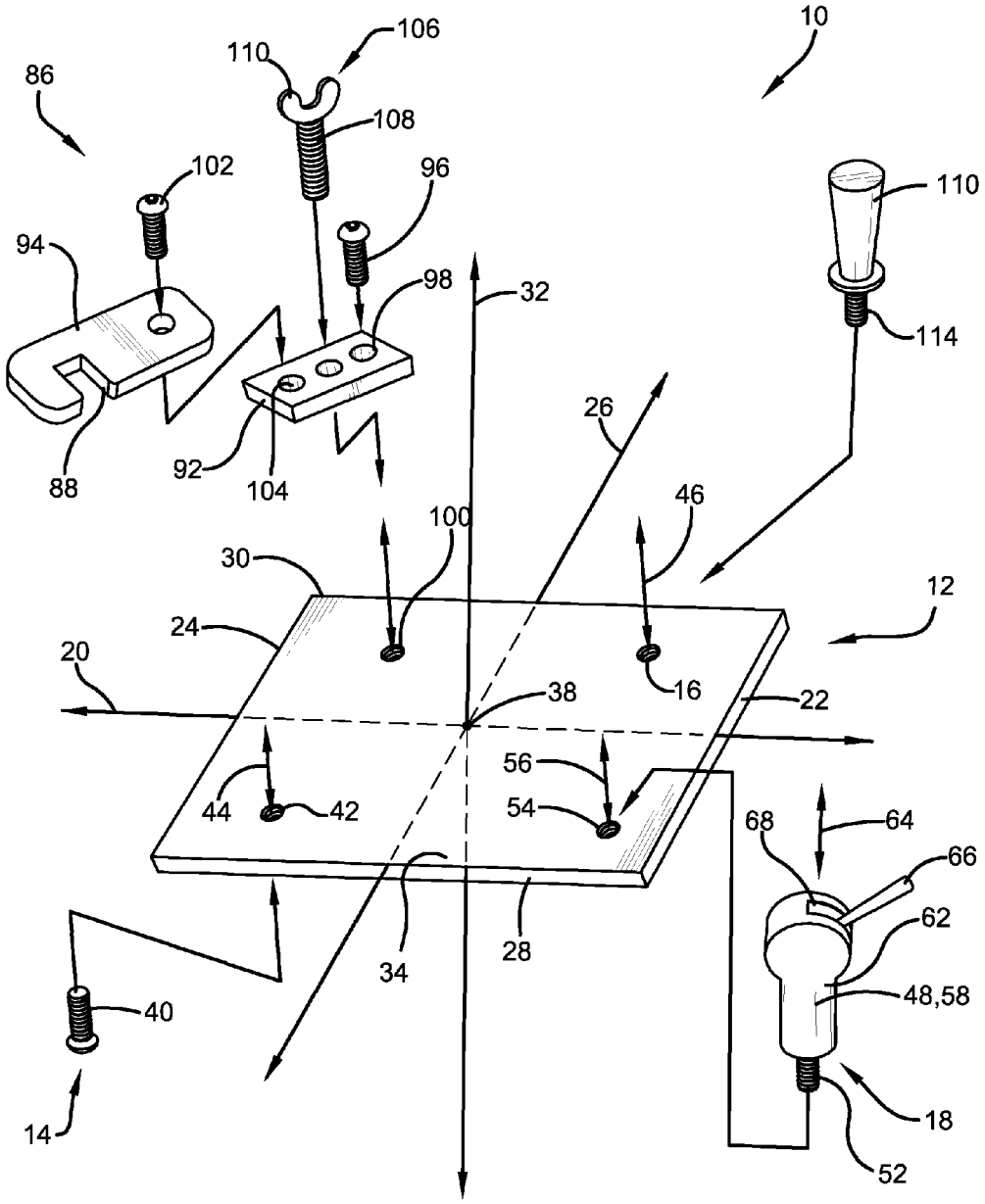
FIG. 1 is an exploded view of a tool fixture according to an exemplary embodiment of the present disclosure.

The present disclosure, as demonstrated by the exemplary embodiment described below, can provide a tool fixture for holding an electrically-powered tool normally held by hand. Embodiments of the tool fixture can support a grinder or a drill, for example. The user can place the tool on the tool fixture and then use the tool while holding a workpiece with two hands.

A tool fixture 10 can include a plate 12, a first bolt 14, a first aperture 16, and a pin actuator assembly 18. The plate 12 can extend a width along a first axis 20 between a right end 22 and a left end 24. The plate 12 can also extend a depth along a second axis 26 perpendicular to the first axis 20 and between a forward end 28 and a rearward end 30. The plate 12 can also extend a height along a third axis 32 perpendicular to the first axis 20 and the second axis 26 and between a top surface 34 and a bottom surface 36. The first axis 20 and the second axis 26 and the third axis 32 can intersect one another at a point 38 evenly spaced between the right end 22 and the left end 24 and evenly spaced between the forward end 28 and the rearward end 30 and evenly spaced between the top surface 34 and the bottom surface 36.

The first bolt 14 can extend away from the top surface 34 and have threads 40 of a first thread configuration. A thread configuration can be defined by a plurality of variables, including diameters (major diameter, pitch diameter, minor diameter, any over wires and wire diameters), tolerances (allowance, major diameter, pitch diameter, minor diameter, length of engagement), V-Shape (pitch, real pitch, crest flat, crest radius max, root flat, root radius, thread depth, flank length), and lead angle (major diameter, pitch diameter, minor diameter). The first bolt 14 can be permanently fixed to the plate 12, such as by welding. Alternatively, the first bolt 14 can be releasibly fixed to the plate 12, such as by being inserted through a second aperture 42 defined by the plate 12. The second aperture 42 can define threads 40 of the first thread configuration. A fastener such as a nut (not shown) can retain the first bolt 14 in position on the plate 12. The first bolt 14 can be centered on a vertical sixth axis 44. The sixth axis 44 can be parallel to and spaced from the third axis 32.

The first aperture 16 can be disposed on an opposite side of the plate 12 relative to the first bolt 14 across the second axis 26, as shown in FIG. 1. The first aperture 16 can extend through the plate 12 and be at least partially threaded. The first aperture 16 can have threads of the first thread configuration. The first aperture 16 can be centered on a vertical seventh axis 46. The seventh axis 46 can be parallel to and spaced from the third axis 32. The first aperture 16 can be fully defined by the plate 12 or can be partially defined by the plate 12 and partially defined by a fastener such as a nut that is welded to the plate 12 (on either the top surface 34 or the bottom surface 36). A portion of the first aperture 16 can be threaded or the entire first aperture 16 can be threaded.

The pin actuator assembly 18 can include a base 48 and a pin 50. The base 48 can include a bolt portion 52 insertable in a third aperture 54 defined by the plate 12. A fastener such as a nut (not shown) can retain the base 48 with the plate 12.

The base 48 can extend away from the top surface 34 and can be disposed on an opposite side of the plate 12 relative to the first bolt 14 across the second axis 26, as shown in FIG. 1. The base 48 can be engaged with the plate 12 for rotation about a fourth axis 56 at least partially spaced from the third axis 32. The fourth axis 56 can be parallel to the third axis 32. The base 48 can be positioned on a same side of the plate 12 as the first aperture 16 with respect to the second axis 26, as shown in FIG. 1. The base 48 can be disposed on an opposite side of the plate 12 relative to the first aperture 16 across the first axis 20, as shown in FIG. 1.

The exemplary base 48 can include a first portion 58 and a second portion 60. The first portion 58 can extend from the top surface 34 vertically along the fourth axis 56 to a distal end 62 spaced from the top surface 34. The second portion 60 can extend horizontally from the distal end 62 of the first portion 58 along a fifth axis 64 transverse to the fourth axis 56.

Figure 2:
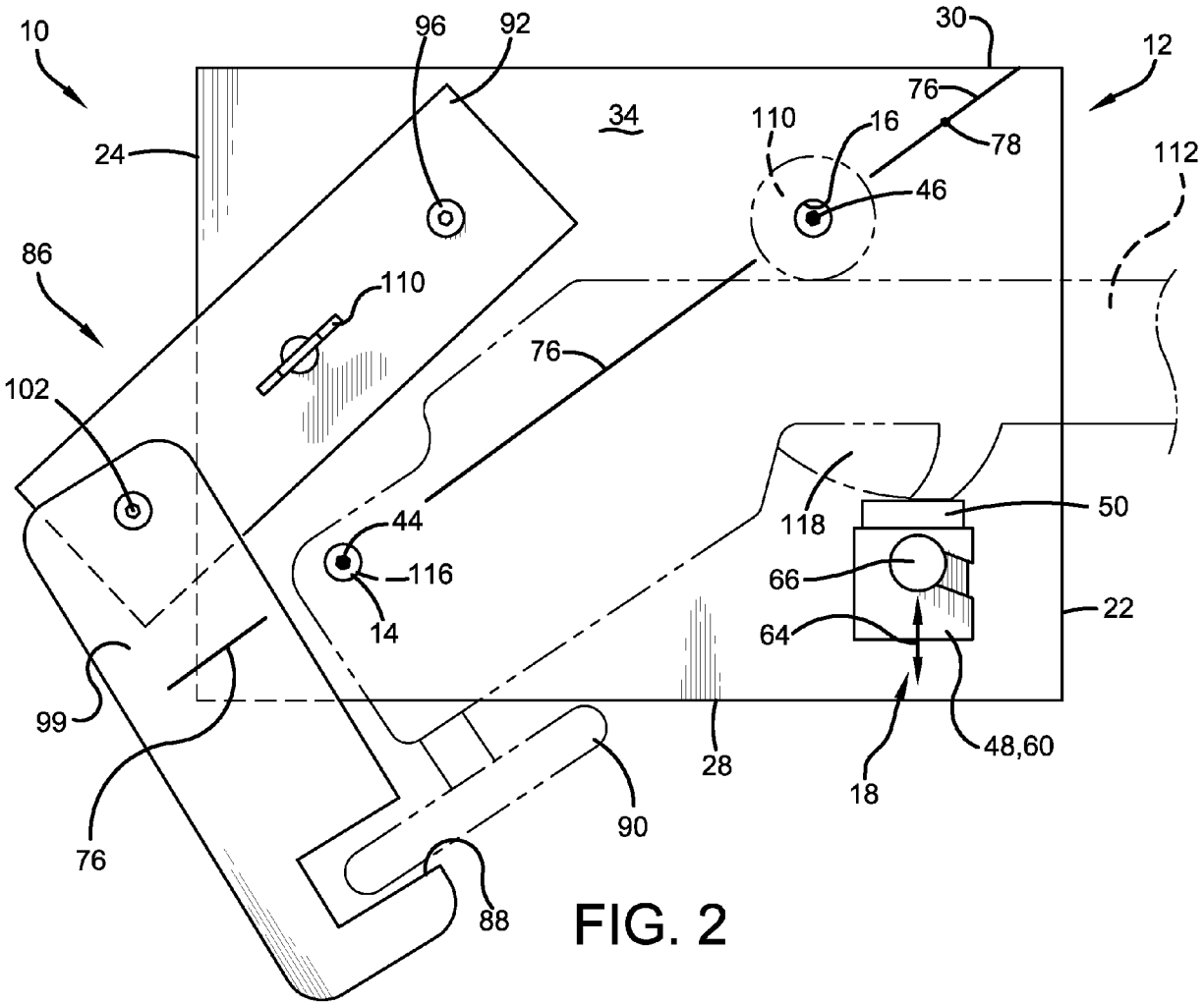
FIG. 2 is a top view of the exemplary tool fixture shown in FIG. 1.
Figure 3:
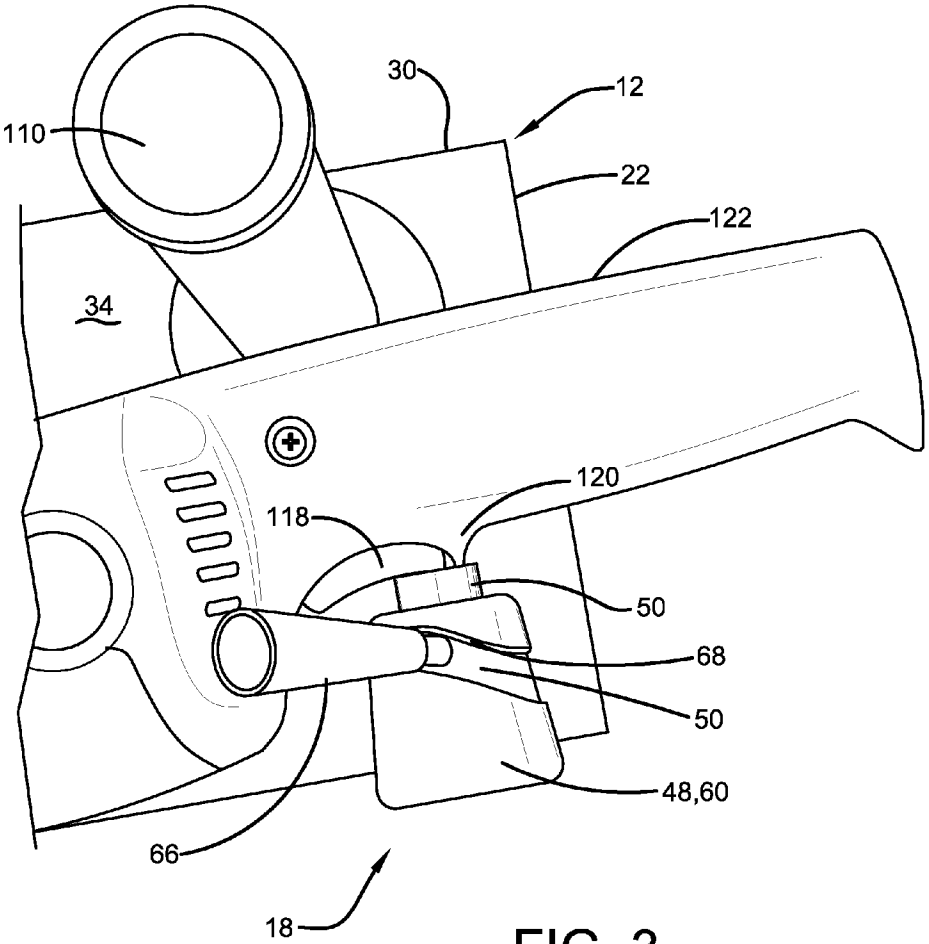
FIG. 3 is an enlarged portion of FIG. 2.
Figure 4:
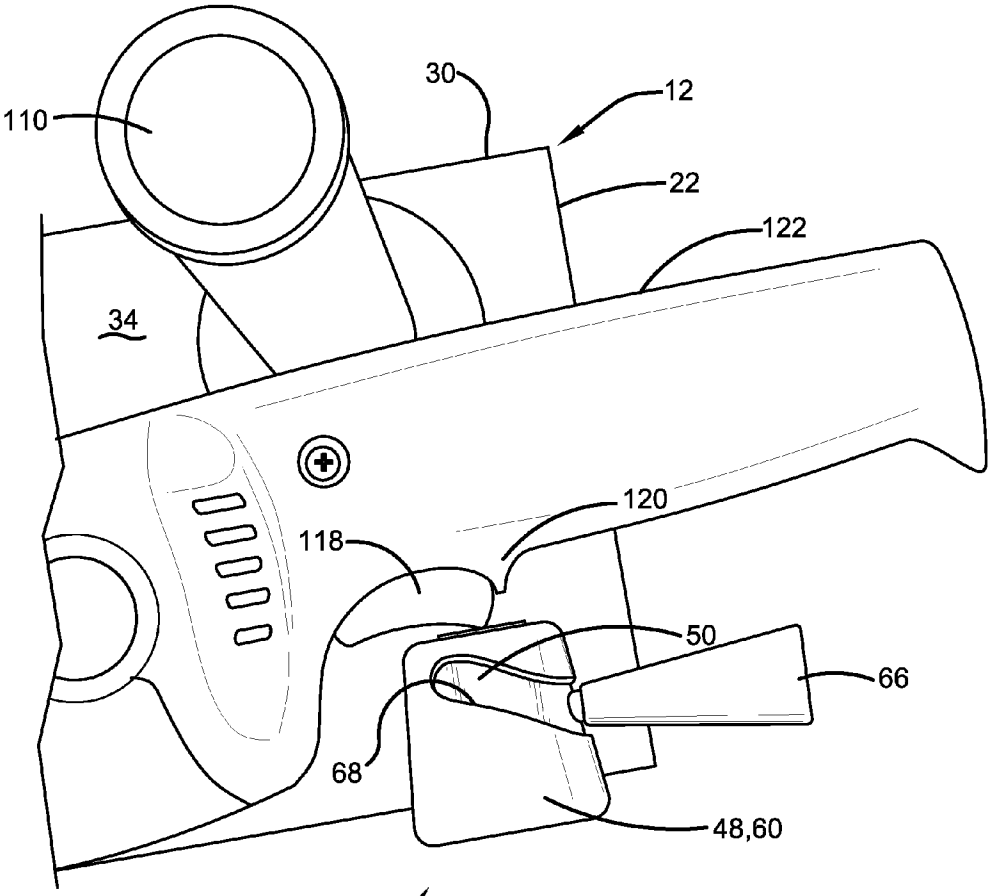
FIG. 4 is a view analogous to FIG. 3 but of a pin in a retracted position.

The pin 50 can be mounted in the base 48 for movement between a retracted position in which a first portion 58 of the pin 50 is enclosed in the base 48 and an extended position in which a second portion 60 of the pin 50 less than the first portion 58 is enclosed in the base 48. The extended position is shown in FIGS. 2 and 3. The retracted position is shown in FIG. 4. The pin 50 can be received in and can be extendable from the second portion 60.

Figure 5:
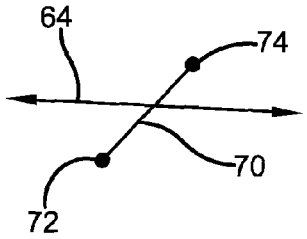
FIG. 5 is a view in a plane parallel to an axis of exemplary movement of the pin relative to a path followed by a slot of a base.
Figure 6:
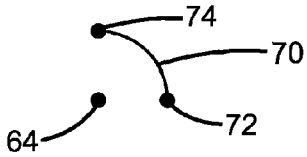
FIG. 6 is a view in a plane perpendicular the axis shown in FIG. 5 and also shows the path followed by the slot of the base.

The tool fixture 10 can also include a lever 66. The lever 66 can pass through the base 48 and fixedly engage with the pin 50. The second portion 60 of the base 48 can define a first slot 68 extending along a path 70. The exemplary path 70 of the first slot 68 extends in an arc about the fifth axis 64, as shown by FIGS. 5 and 6. The lever 66 can be moveable in the first slot 68 between a first end limit 72 of travel and a second end limit 74 of travel. The first end limit 72 of travel can be defined when the pin 50 is in the retracted position and the second end limit 74 of travel defined when the pin 50 is in the extended position.

The exemplary pin 50 can move rectilinearly in response to movement of the lever 66 in the first slot 68 between the first end limit 72 of travel and the second end limit 74 of travel. The exemplary pin 50 can also rotate in response to movement of the lever 66 in the first slot 68 between the first end limit 72 of travel and the second end limit 74 of travel. The exemplary first slot 68 of the base 48 can act as a cam. The exemplary lever 66 and pin 50 can concurrently act as a cam follower during movement of the lever 66 in the first slot 68 between the first end limit 72 of travel and the second end limit 74 of travel.

The sixth axis 44 and the seventh axis 46 can be coplanar, contained in a common plane. This plane is referenced at 76 in FIG. 2. The pin 50 is closer to the plane 76 when in the extended position than when in the retracted position. The pin 50 moves rectilinearly between the extended position and the retracted position along the fifth axis 64. The fifth axis 64 can be parallel to and spaced from the second axis 26 and can be transverse to the plane 76. The pin 50 can thus move in a direction perpendicular to the fourth axis 56. The pin 50 can rotate while moving in the direction perpendicular to the fourth axis 56. The fifth axis intersects the first plane at a first position 78. The seventh axis 46 is between the first position 78 and the sixth axis 44 in the first plane 76.

Figure 7:
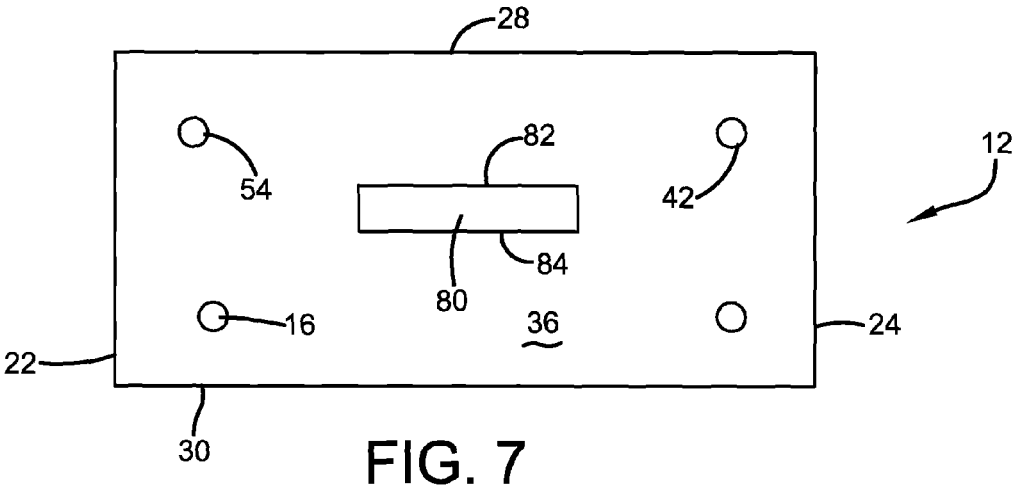
FIG. 7 is a bottom view of a plate.
Figure 8:
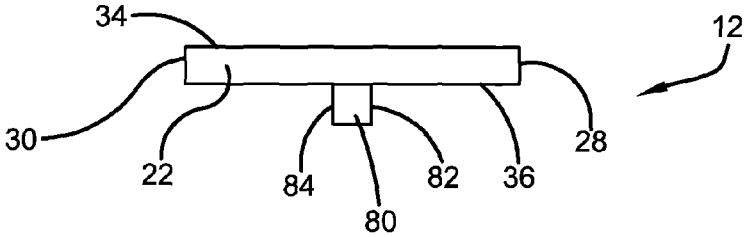
FIG. 8 is a side view of the plate.

As shown in FIGS. 7 and 8, the tool fixture 10 can also include a block 80. The block 80 can project away from the bottom surface 36 and having first and second oppositely-facing surfaces 82, 84 that are parallel to one another and each perpendicular to the bottom surface 36. The first and second oppositely-facing surfaces 82, 84 can be closer together along the second axis 26 than the forward end 28 and the rearward end 30. The block 80 can be positioned in a vice when the too fixture 10 is in operation. It is noted that other approaches to mounting the tool fixture 10 can be applied in other embodiments, such as C-clamps, welding grips, or even the head of the first bolt 14.

The tool fixture 10 can also include a fork 86. The fork 86 can be engaged with the plate 12. The fork 86 can define a second slot 88 configured to be disposed on opposite sides of a rotating tool. FIG. 2 shows the second slot 88 disposed on opposite sides of a rotating tool in the form of a grinding wheel 90 (shown in phantom).

The fork 86 can include a first beam member 92 and a second beam member 94. The first beam member 92 can be mounted to the plate 12 for rotation. A bolt member 96 can pass through an aperture 98 in the first beam member 92 and an aperture 100 in the plate 12. A fastener such as a nut (not shown) can retain the bolt member 96 in position on the plate 12.

The second beam member 94 mounted to the first beam member 92 for rotation. A bolt member 102 can pass through an aperture 104 in the first beam member 92. A fastener such as a nut (not shown) can retain the bolt member 96 in position between the first beam member 92 and second beam member 94. The second slot 88 can be define by the second beam member 94.

The fork 86 can also include a locking assembly 106. The exemplary locking assembly 106 can include a second bolt 108 with a wing-nut head 110. The second bolt 108 can extend through and be threadingly engaged with the first beam member 92. Rotation of the second bolt 108 in a first direction increases friction between the second bolt 108 and the top surface 34 to lock the first beam member 92 relative to the plate 12. Rotation of the second bolt 108 in a second direction opposite to the first direction lifts the tip of the second bolt 108 from the top surface 34 and decreases or eliminates friction between the second bolt 108 and the top surface 34 to unlock the first beam member 92 relative to the plate 12.

In view of the disclosure above, the exemplary fork 86 is mounted on the plate 12 for adjustable positioning. The fork 86 is mounted for rotation on the plate 12. Further, the exemplary fork 86 is releasibly mounted for rotation on the plate 12.

Figure 9:
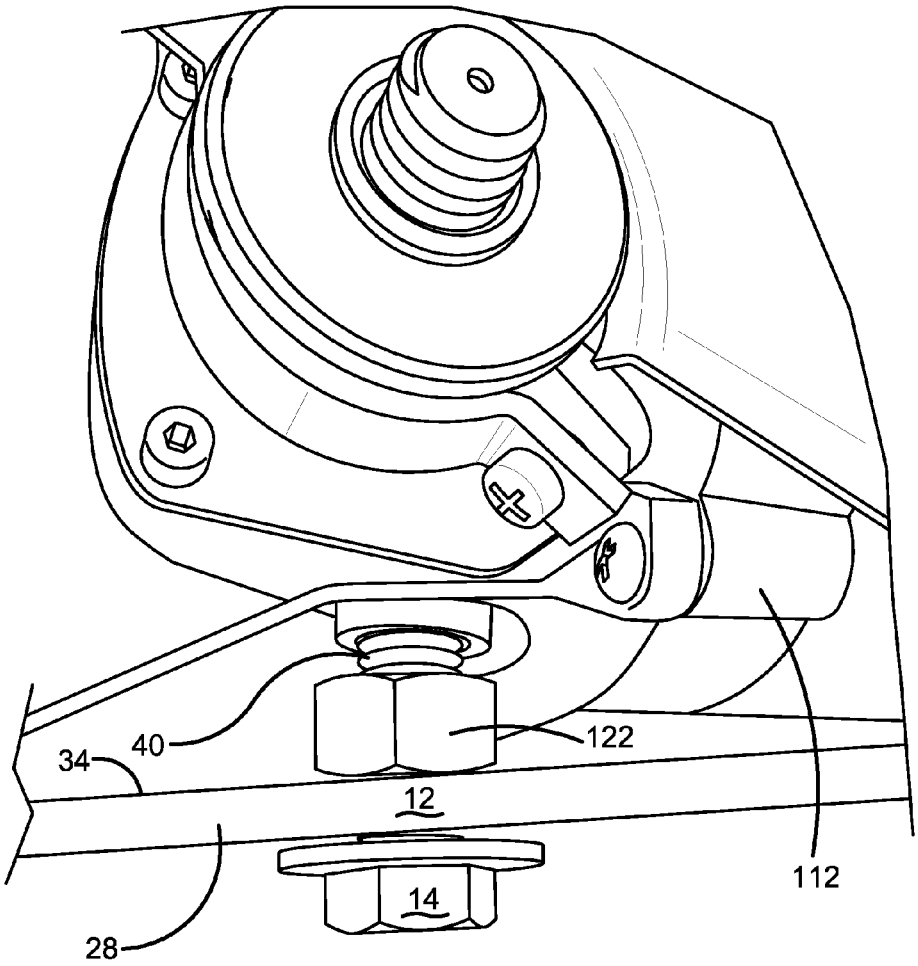
FIG. 9 is frontal view of a portion of the exemplary embodiment.

In operation, a user can then remove a handle 110 from a tool such as a grinder 112. The handle 110 can include a threaded shank 114 engaged with a threaded aperture 116 defined by the grinder 112. The pin actuator assembly 18 can be rotated about the fourth axis 56 to permit the grinder 112 to be laid on the plate 12. The first bolt 14 can then be threadingly engaged with the threaded aperture 116 since the threaded shank 114 has been removed. FIG. 9 shows a view of this and shows a spacer 122 disposed between the surface 34 and the grinder 112. The handle 110 can then be mounted on the plate 12 by threadingly inserting the threaded shank 114 in the first aperture 16. The user can then position the plate 12 in a vise and tighten the vise on the block 86.

The grinder 112 can then be moved against the handle 110 and the pin actuator assembly 18 can be rotated about the fourth axis 56 such that the footprint of movement of the pin 50 intersects a footprint of movement of a trigger 118 of the grinder 112. The pin 50 can initially be in the retracted position when the pin actuator assembly 18 is rotated about the fourth axis 56 into a desired position, as shown in FIG. 4. In such a spatial arrangement of the structures, the trigger 118 can be fully extended and thereby preventing power from turning the grinding wheel 90. However, a spring biasing the trigger 118 outward can cooperate with the pin actuator assembly 18 to steady the position of the grinder 112.

The user can then grasp the lever 66 and rotate the lever 66 from the first end limit of travel 72, along the path 70, to the second end limit 74 of travel. In so doing, the pin 50 moves from the retracted position (as shown in FIG. 4) to the extended position (shown in FIG. 3). Further, the pin 50 urges the trigger 118 from an extended position (as shown in FIG. 4) to an at least partially retracted position (shown in FIG. 3). Further, movement of the trigger 118 from the extended position to the at least partially retracted position allows current to flow in the grinder 112 and the grinding wheel 90 to turn.

By being rotatable, the pin actuator assembly 18 can be selectively positioned such that the pin 50 can fully or only partially engage the trigger 118. In FIGS. 3 and 4, the pin 50 partially engages the trigger 118 and also engages a trigger guard 120. This allows the grinder 112 to be held in position, with power engaged, while be supported at three spaced and solid positions: the aperture 116, a top surface 122, and the trigger guard 120. The trigger 118 need not be subject to loading applied to hold the grinder 112. Alternatively, the pin actuator assembly 18 could have been positioned such that the pin 50 would fully engage the trigger 118 and not engage the trigger guard 120.

After the grinder 112 is positioned, the fork 86 can be rotated into position and work can begin.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. A tool fixture for electrically-powered hand tools comprising:

a plate extending a width along a first axis between a right end and a left end and extending a depth along a second axis perpendicular to said first axis and between a forward end and a rearward end and extending a height along a third axis perpendicular to said first axis and said second axis and between a top surface and a bottom surface, said first axis and said second axis and said third axis intersecting one another at a point evenly spaced between said right end and said left end and evenly spaced between said forward end and said rearward end and evenly spaced between said top surface and said bottom surface;

a first bolt extending away from said top surface and having threads of a first thread configuration;

a first aperture disposed on an opposite side of said plate relative to said first bolt across said second axis, said first aperture extending through said plate and at least partially threaded, said first aperture having threads of the first thread configuration; and a pin actuator assembly including a base and a pin, said base extending away from said top surface and disposed on an opposite side of said plate relative to said first bolt across said second axis, said base engaged with said plate for rotation about a fourth axis at least partially spaced from said third axis, said base positioned on a same side of said plate as said first aperture with respect to said second axis, said pin mounted in said base for movement between a retracted position in which a first portion of said pin is enclosed in said base and an extended position in which a second portion of said pin less than said first portion is enclosed in said base, said base disposed on an opposite side of said plate relative to said first aperture across said first axis.

2. The tool fixture of claim 1 further comprising:

a lever passing through said base and fixedly engage with said pin.

3. The tool fixture of claim 2 wherein said base defines a first slot extending along a path and said lever is moveable in said first slot between a first end limit of travel and a second end limit of travel, said first end limit of travel defined when said pin is in said retracted position and said second end limit of travel defined when said pin is in said extended position.

4. The tool fixture of claim 3 wherein said pin moves rectilinearly in response to movement of said lever in said first slot between said first end limit of travel and said second end limit of travel.

5. The tool fixture of claim 4 wherein said pin rotates in response to movement of said lever in said first slot between said first end limit of travel and said second end limit of travel.

6. The tool fixture of claim 3 wherein said first slot of said base acts as a cam and said lever and said pin concurrently act as a cam follower during movement of said lever in said first slot between said first end limit of travel and said second end limit of travel.

7. The tool fixture of claim 3 wherein said base further comprises:

a first portion extending from said top surface vertically along said fourth axis to a distal end spaced from said top surface; and a second portion extending horizontally from said distal end of said first portion along a fifth axis transverse to said fourth axis, said pin received in and extendable from said second portion.

8. The tool fixture of claim 7 wherein said path of said first slot extends in an arc about said fifth axis.

9. The tool fixture of claim 1 wherein said first bolt is centered on a vertical sixth axis and said first aperture is centered on a vertical seventh axis, said sixth axis and said seventh axis each parallel to and spaced from said third axis, said sixth axis and said seventh axis contained in a first plane, and said pin closer to said first plane when in said extended position than when in said retracted position.

10. The tool fixture of claim 9 wherein said pin moves rectilinearly between said extended position and said retracted position along a fifth axis, said fifth axis parallel to and spaced from said second axis and transverse to said first plane.

11. The tool fixture of claim 10 wherein said fifth axis intersects said first plane at a first position wherein said seventh axis is between said first position and said sixth axis in said first plane.

12. The tool fixture of claim 1 wherein said pin moves in a direction perpendicular to said fourth axis.

13. The tool fixture of claim 12 wherein said pin rotates while moving in said direction perpendicular to said fourth axis.

14. The tool fixture of claim 1 wherein said fourth axis is parallel to said third axis.

15. The tool fixture of claim 1 further comprising:

a block projecting away from said bottom surface and having first and second oppositely-facing surfaces that are parallel to one another and each perpendicular to said bottom surface, said first and second oppositely-facing surfaces being closer together along said second axis than said forward end and said rearward end.

16. The tool fixture of claim 1 further comprising:

a fork engaged with said plate and defining a second slot configured to be disposed on opposite sides of a rotating tool.

17. The tool fixture of claim 16 wherein said fork is mounted on said plate for adjustable positioning.

18. The tool fixture of claim 17 wherein said fork is mounted for rotation on said plate.

19. The tool fixture of claim 18 wherein said fork is releasibly mounted for rotation on said plate.

20. The tool fixture of claim 19 wherein said fork further comprises:

a first beam member mounted to said plate for rotation;

a second beam member mounted to said first beam member for rotation, said second slot defined by said second beam member; and a locking assembly including a second bolt with a wing-nut head extending through and threadingly engaged with said first beam member, wherein rotation of said second bolt in a first direction increases friction between said second bolt and said top surface to lock said first beam member relative to said plate.

* * * * *